US005083532A

United States Patent [19]

Wiesen

[11] Patent Number: 5,083,532

[45] Date of Patent: Jan. 28, 1992

[54] MECHANISM FOR VARIABLE COMPRESSION RATIO AXIAL ENGINES

[76] Inventor: Bernard Wiesen, 15 Beach Rd., Great Neck, N.Y. 11023

[21] Appl. No.: 617,362

[22] Filed: Nov. 23, 1990

[51] Int. Cl.[5] ..... F02B 75/26

[52] U.S. Cl. ..... 123/58 B; 123/48 R; 123/78 R

[58] Field of Search ..... 123/58 B, 58 BA, 58 BB, 123/58 C, 48 R, 78 BA, 78 E, 78 R

[56] References Cited

U.S. PATENT DOCUMENTS

| | | | |
|---|---|---|---|
| Re. 17,879 | 11/1930 | Michell . | |
| 1,698,102 | 1/1929 | Michell . | |
| 1,825,691 | 10/1931 | Hall . | |
| 1,968,470 | 7/1934 | Szombathy | 123/58 R |
| 2,083,730 | 6/1937 | Michell | 123/58 BB |
| 2,152,811 | 4/1939 | Michell | 123/48 B |
| 2,644,021 | 6/1953 | Hittell | 123/48 B |
| 2,957,462 | 10/1960 | Clark | 123/58 BC |
| 3,673,991 | 7/1972 | Winn | 123/58 A |
| 4,023,542 | 5/1977 | Ango | 123/58 R |
| 4,174,684 | 11/1979 | Roseby et al. | 123/58 BC |
| 4,294,139 | 10/1981 | Bex et al. | 123/58 B |
| 4,433,596 | 2/1984 | Scalzo | 123/58 B |
| 4,454,779 | 6/1984 | Vos | 123/58 B |
| 4,510,894 | 4/1985 | Williams | 123/58 A |
| 4,553,508 | 11/1985 | Stinebaugh | 123/58 AA |
| 4,622,927 | 11/1986 | Wenker | 123/58 B |
| 4,905,637 | 3/1990 | Ott | 123/58 B |

FOREIGN PATENT DOCUMENTS 252225 5/1926 United Kingdom .

*Primary Examiner*—David A. Okonsky

[57] ABSTRACT

This invention relates to internal combustion engines in which the cylinders are arranged parallel to the main shaft and the reciprocating movements of the pistons are converted to rotation by means of a swashplate, and more particularly to means for automatically varying the combustion chamber volume to get at all times the maximum combustion chamber pressure permissible. Various embodiments of the invention are shown and involve changing the compression ratio by the controlled movements of a fluid under the action of the gas pressure in the combustion chambers. The movement of the fluid being controlled variously and in combination by check valves, spring loaded discharge valves and discharge orifices arranged and adjusted to give the required changes in position in accordance with the engine load with the use of spring pressure to maintain a balanced condition in the various arrangements.

5 Claims, 9 Drawing Sheets

MECHANISM FOR VARIABLE COMPRESSION RATIO AXIAL ENGINES

BACKGROUND OF THE INVENTION

Since the beginning of the twentieth century inventors have proposed many solutions to vary the compression ratio of internal combustion engines. Almost all of them were found to be ineffective, impractical or too complicated to be used except in limited production in areas outside the usual commercial engine markets where higher initial cost and costly maintenance were considered acceptable.

In internal combustion engines as usually constructed the clearance volume is fixed. The pressure to which the air in the combustion chamber can be compressed is limited by practical considerations. In order that the power cylinder may receive larger quantities of air without exceeding the permissible pressure means must be provided for increasing the clearance volume when required.

It has been demonstrated that compression-ignition engines require peak pressure control devices that are completely automatic if better power-to-weight ratios as well as substantial improvements in cold starting ability and potential for multi-fuel operation and greater economy in production is to be obtained.

In spark-ignition engines it is apparent that a practical variable compression ratio device would also permit a significant improvement in part load fuel consumption without reducing the maximum output potential and eliminates the harmful effects of detonation and permit the use of fuels with lower octane ratings.

As the current trend to pressure charge engines continues it becomes evident that future internal combustion engines will require some type of automatic peak pressure control device if higher power-to-weight ratios and improved fuel economies are to be achieved.

SUMMARY OF THE INVENTION

The invention consists of a construction in which a shaft is combined with a hydraulic piston which is fixed in relation to the rest of the mechanism. Said combination contains oil passages through the shaft and past check valves in each side of the piston and a pressure relief valve occupying a passage that communicates with each side of the piston. A swashplate and hydraulic cylinder are combined to surround and "float over and around" the shaft and piston combination forming a chamber on each side of the annular piston with freedom to move axially to the shaft-piston combination, and mean included to keep the shaft-piston combination and swashplate-cylinder combination rotating together. Springs are used in one chamber to overcome the mean effective pressure on the swashplate while running at less than full loads with the ability to adjust and vary the position of the swashplate relative to the shaft.

In accordance with the invention there is provided means whereby the compression ratio of an engine is automatically varied, mainly in accordance with the maximum gas pressure acting on the swashplate, thereby to obtain at each condition of operation the highest permissible compression ratio. A pressure relief valve of fixed value is used to match the highest combustion chamber pressure for the engine structure. As this value is reached the pressure relief valve releases fluid from one chamber of the hydraulic cylinder causing the swashplate-cylinder combination to move axially thereby increasing the clearance volume in the combustion chamber. The chamber on the opposite side of the hydraulic cylinder acts as a dash pot with a restrictive orifice which is sized to control the rate of movement in the other direction. A spring or springs return the swashplate-cylinder combination to the higher compression ratio positions when a reduction in load occurs.

Means to easily and accurately adjust the relative positions of two such assemblies in two-cycle opposed piston engines where an out of phase relationship is desirable for efficient scavenging and pressure charging of the cylinders and the ability to make changes in these engines when different timing relationships are also necessary. Means to simply adjust the minimum and maximum clearance volume are provided to insure accurate assembly in such engines.

BRIEF DESCRIPTION OF THE DRAWINGS

A better understanding of the present invention will be had upon reference to the following detailed description when read in conjunction with the accompanying drawings, wherein like reference characters refer to like parts throughout the several views, and in which.

DETAILED DESCRIPTION OF THE INVENTION

Figure 1:
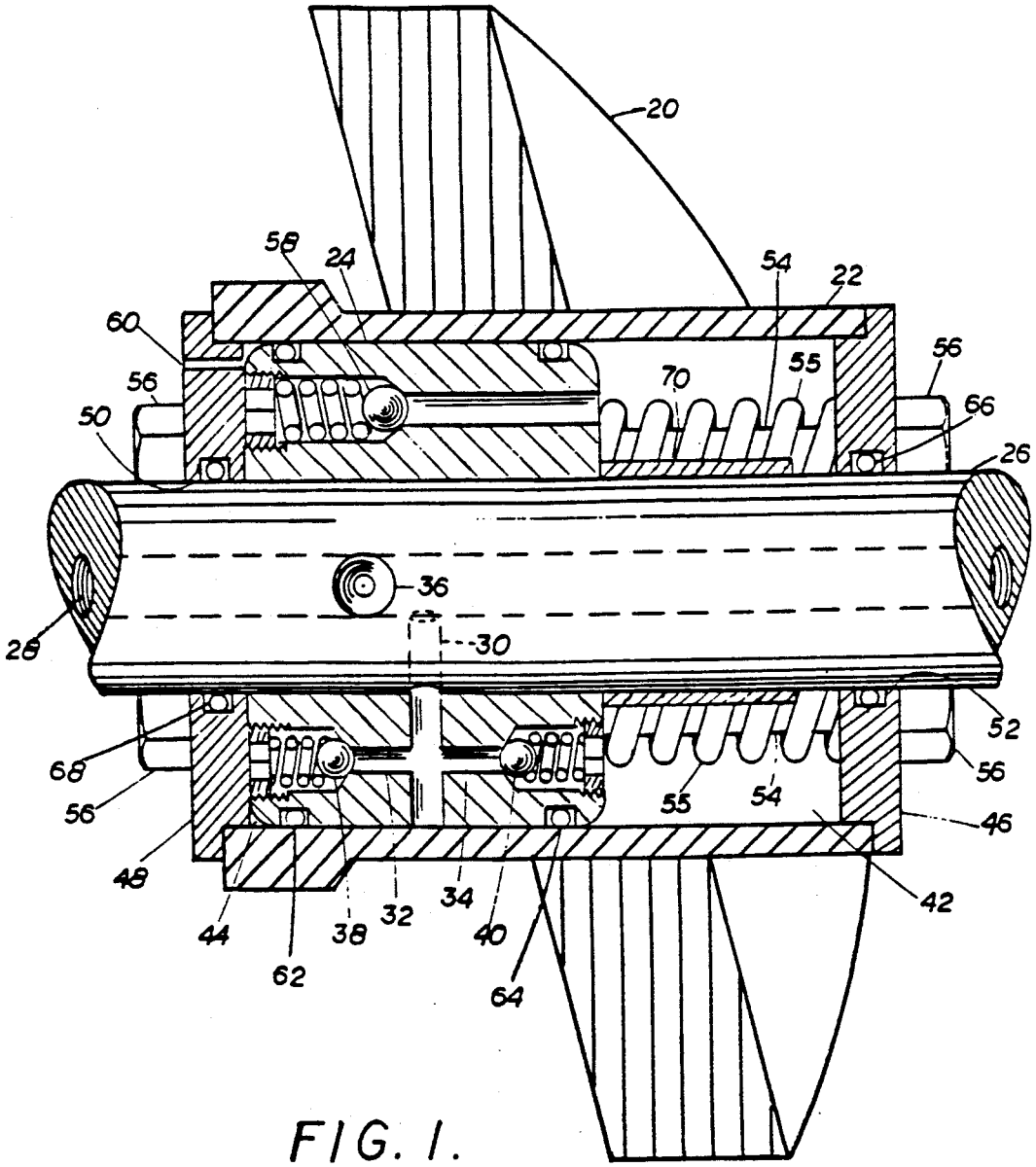
FIG. 1 is a view in section of a first embodiment of the invention taken along line 1—1 of FIGS. 4 and 5.
Figure 2:
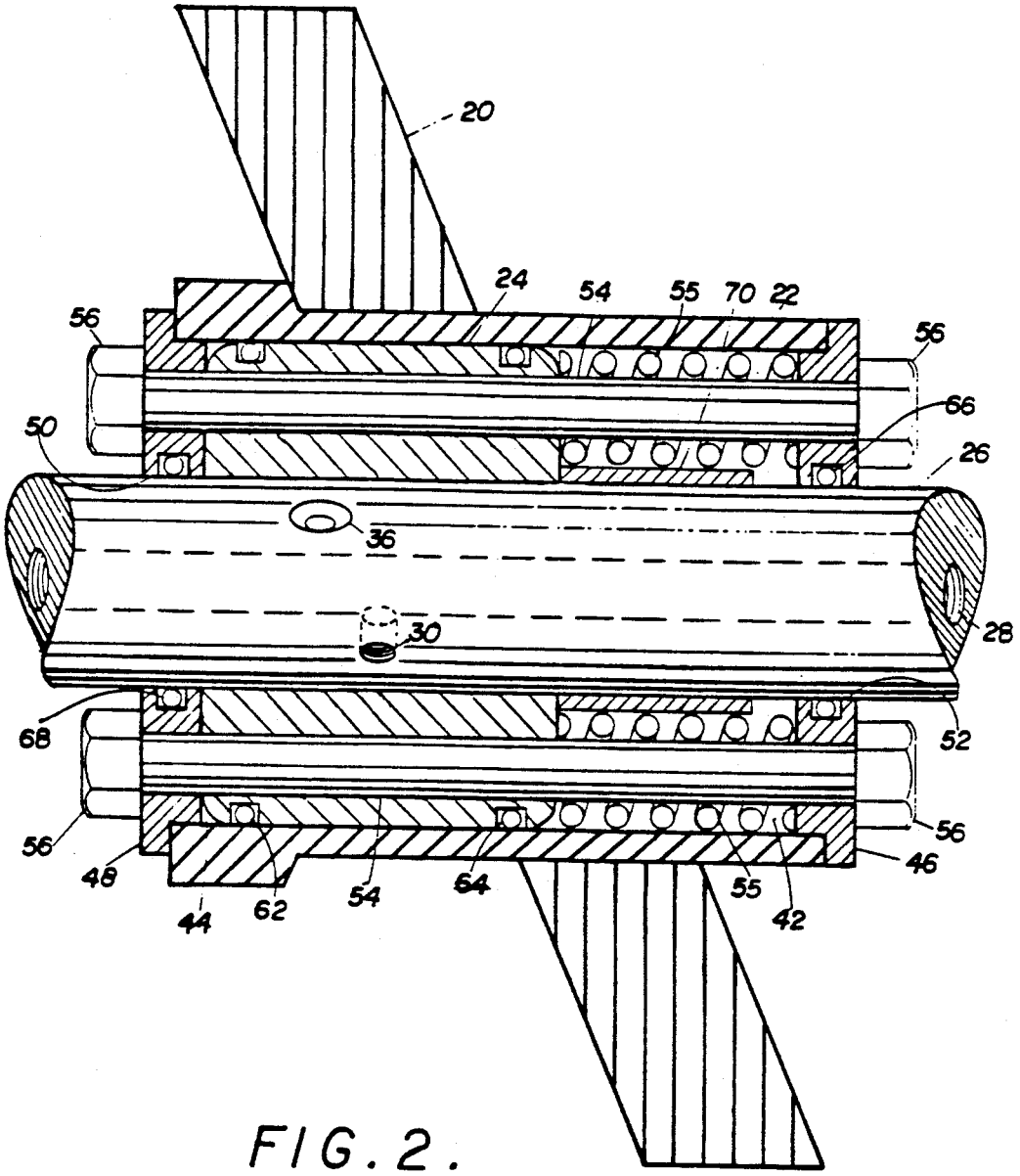
FIG. 2 is a view in section of a first embodiment of the invention taken along line 2—2 of FIGS. 4 and 5.
Figure 3:
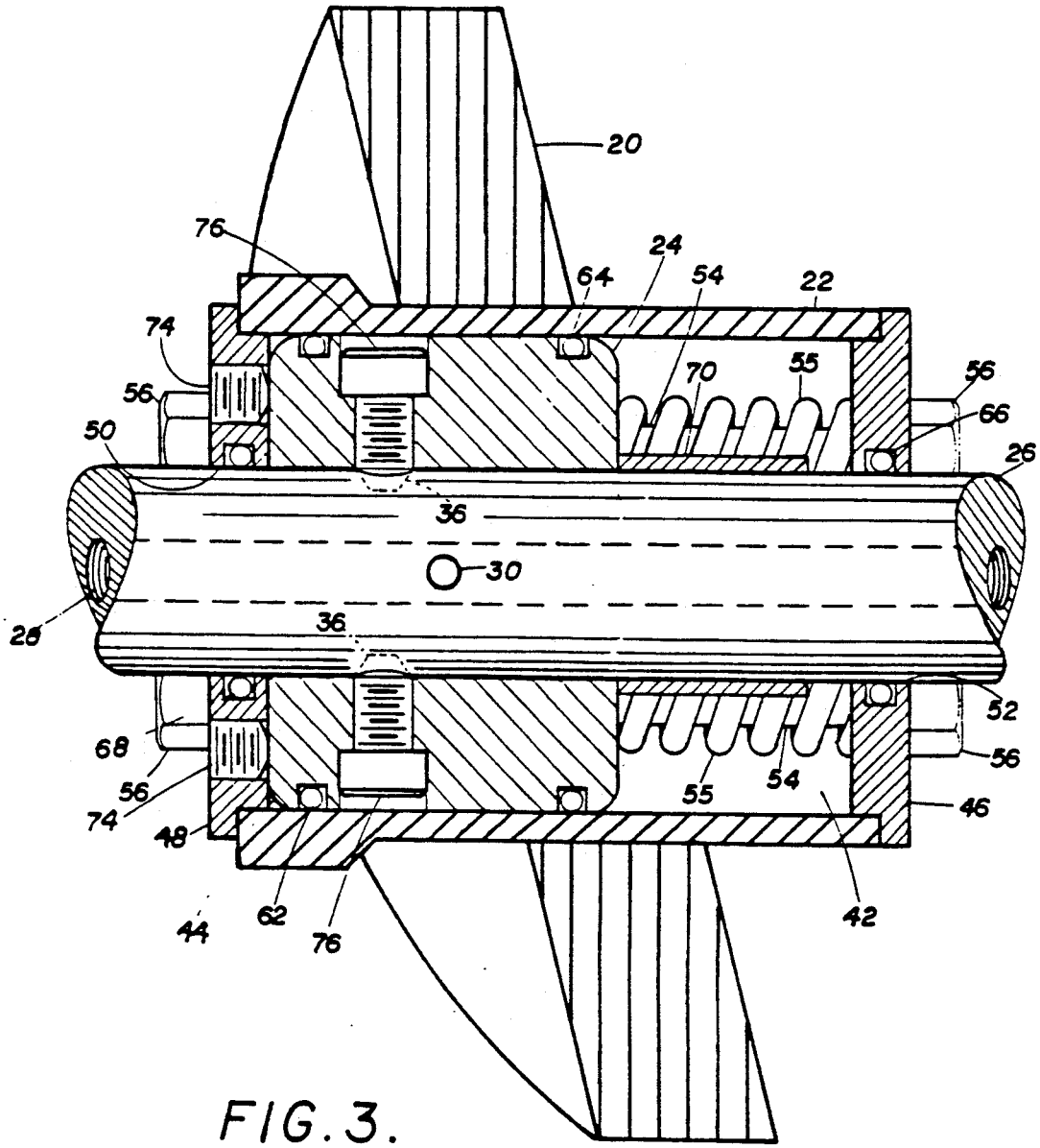
FIG. 3 is a view in section of a first embodiment of the invention taken along line 3—3 of FIGS. 4 and 5.
Figure 4:
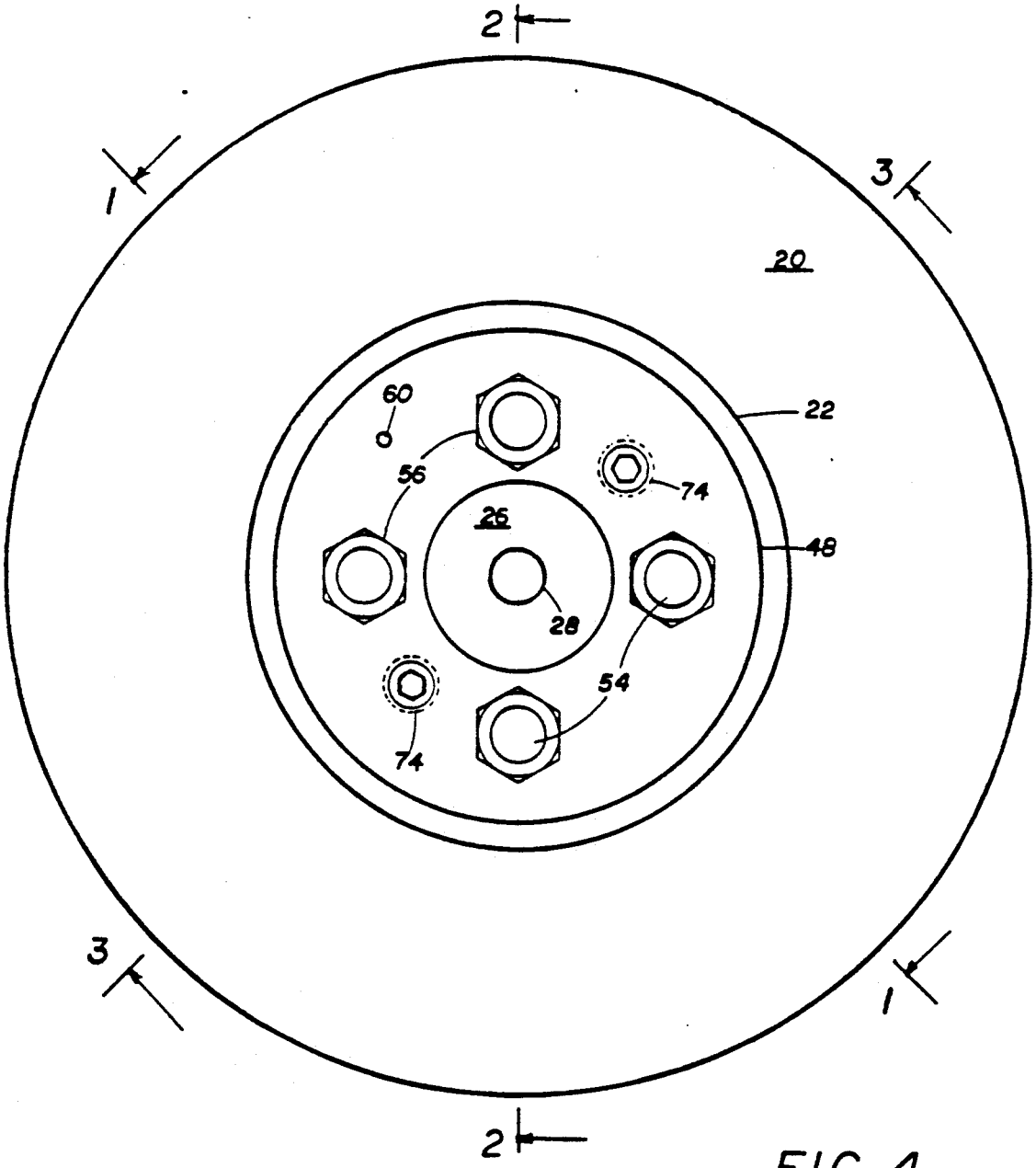
FIG. 4 is an end view of a first embodiment of the invention.
Figure 5:
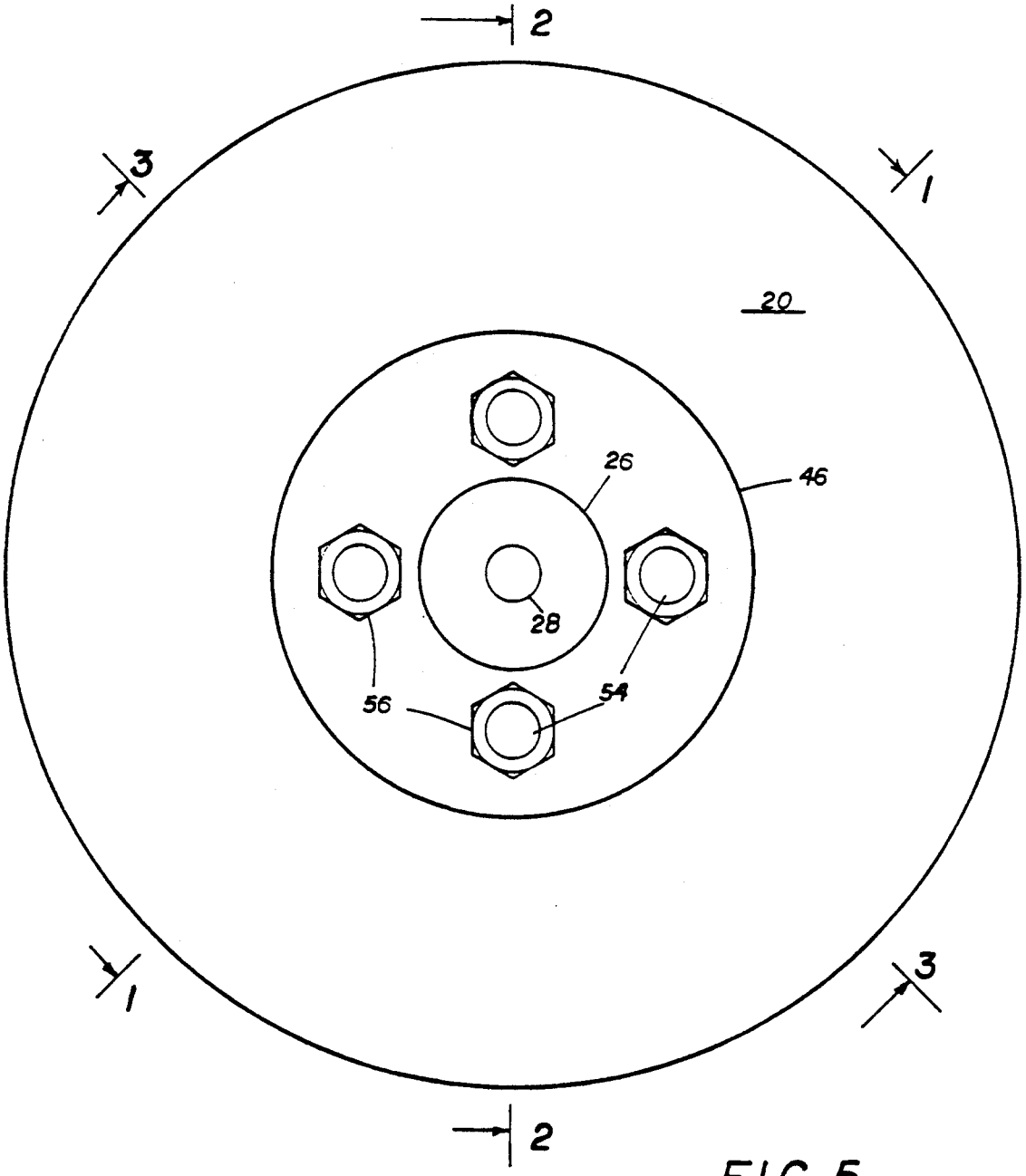
FIG. 5 is another end view of a first embodiment of the invention.

Referring to FIGS. 1–5 inclusive, the swashplate 20 is combined with the cylinder 22 by appropriate means (not shown). The annular piston 24 is combined with shaft 26 with the use of screws 76 threaded through piston 24 into depression 36 in shaft 26, it being understood that other means of attachment can also be employed. A passage 28 formed through the shaft 26 communicates with the lubrication system of the engine by means not shown. Oil flows from a pump through passageway 28, 30 and passageway 32 through one-way check valve 38 to dash pot chamber 44. Oil also flows through passageway 34 through one-way check valve 40 to keep chamber 42 filled with oil. The method shown to keep all the elements of the mechanism rotating together employs the use of rods 54 that pass through bores in the piston 24 and end plates 46 and 48, which define the chambers 42 and 44 with fasteners 56 compressing end plates 46 and 48 against ends of cylinder 22 forming a unitary structure that slides along the shaft 26, on the bearing surfaces 50 and 52, with rods 54 sliding through bores in the piston 24. It being understood that other means that will permit the slidable engagement of the elements and keep all the elements of the mechanism rotating together can also be employed. A pressure relief valve 58 reacts to the amount of pressure in chamber 42 as a direct result of the forces originating in the combustion chambers in the engine acting on the pistons that in turn transmits this pressure to slipper pad bearings (not shown) that communicate with the surface of the swashplate that is on the side of chamber 42. When the set value of the pressure relief valve 58 is reached it opens, transferring oil from chamber 42 through the piston into chamber 44, permitting the axial movement of the swashplate-cylinder combination. It should be understood that a pressure relief valve could be housed in end plate 46, to relieve the pressure in chamber 42 and dumping oil from chamber 42 into the sump of the engine. Although one type of pressure relief valve is shown it should be understood that one of the many kinds of pressure relief valves can be used. A tube 70 defines the limit of movement of the cylinder-swashplate combination along the piston-shaft combination. Chamber 42 houses a spring or springs 55 that return the assembly to the higher compression ratio positions when a reduction in pressure allow for it. End plate 48 contains a small opening 60 that restricts somewhat the flow of oil leaving chamber 44 controlling the movement of the mechanism at a predetermined rate, allowing chamber 44 to act as a dash pot. Seals 66 and 68 maintain a leakproof condition in chambers 42 and 44. Seals 62 and 64 provide seal between the piston 24 and cylinder 22 in the area of their sliding contact. Set screws 74 in end plate 48 adjust and permit the exact positioning of the mechanism in the engine frame and determines what the highest compression ratio will be for a specific engine.

Figure 6:
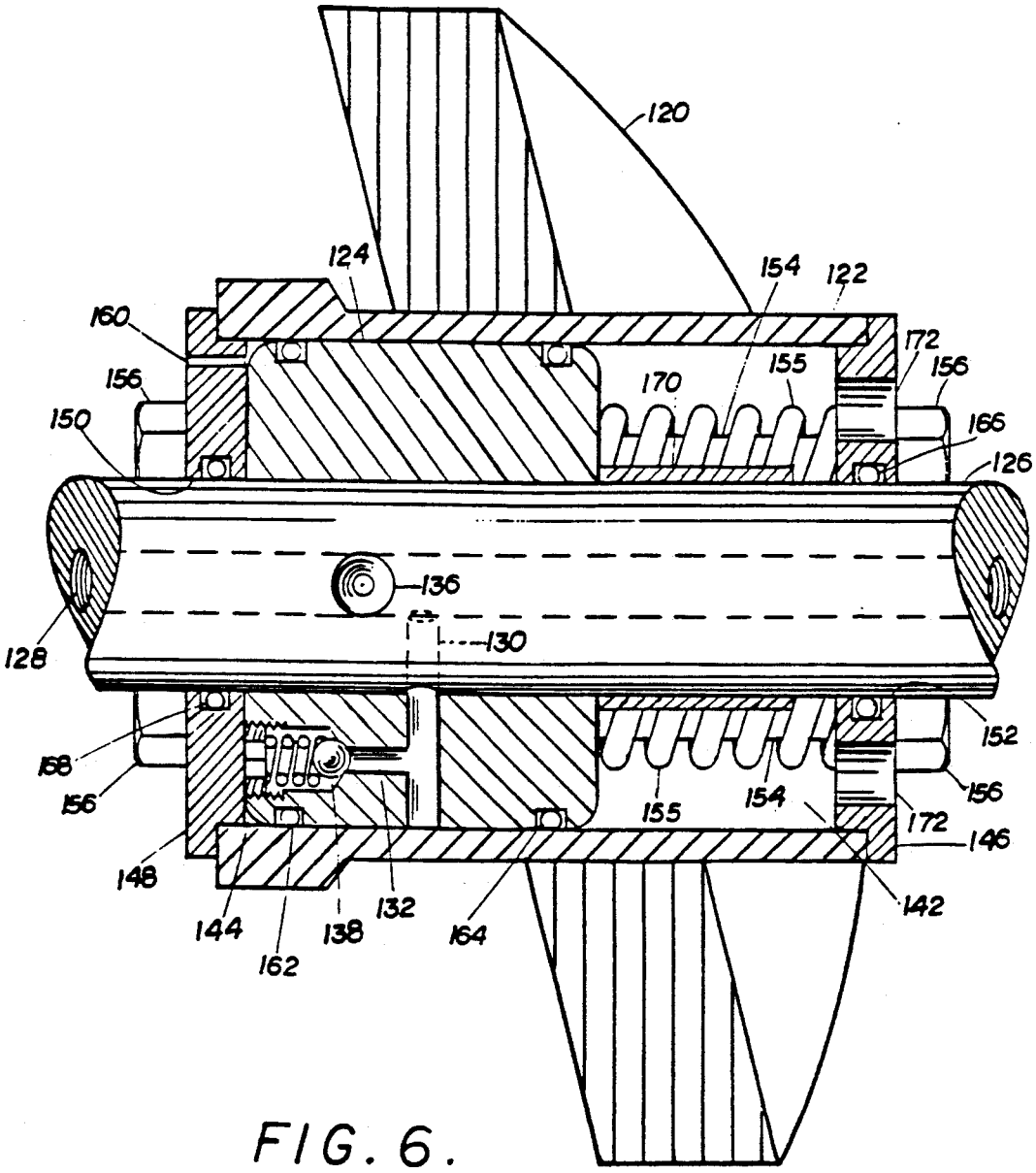
FIG. 6 is a view in section of a second embodiment of the invention taken along line 6—6 of FIG. 7.
Figure 7:
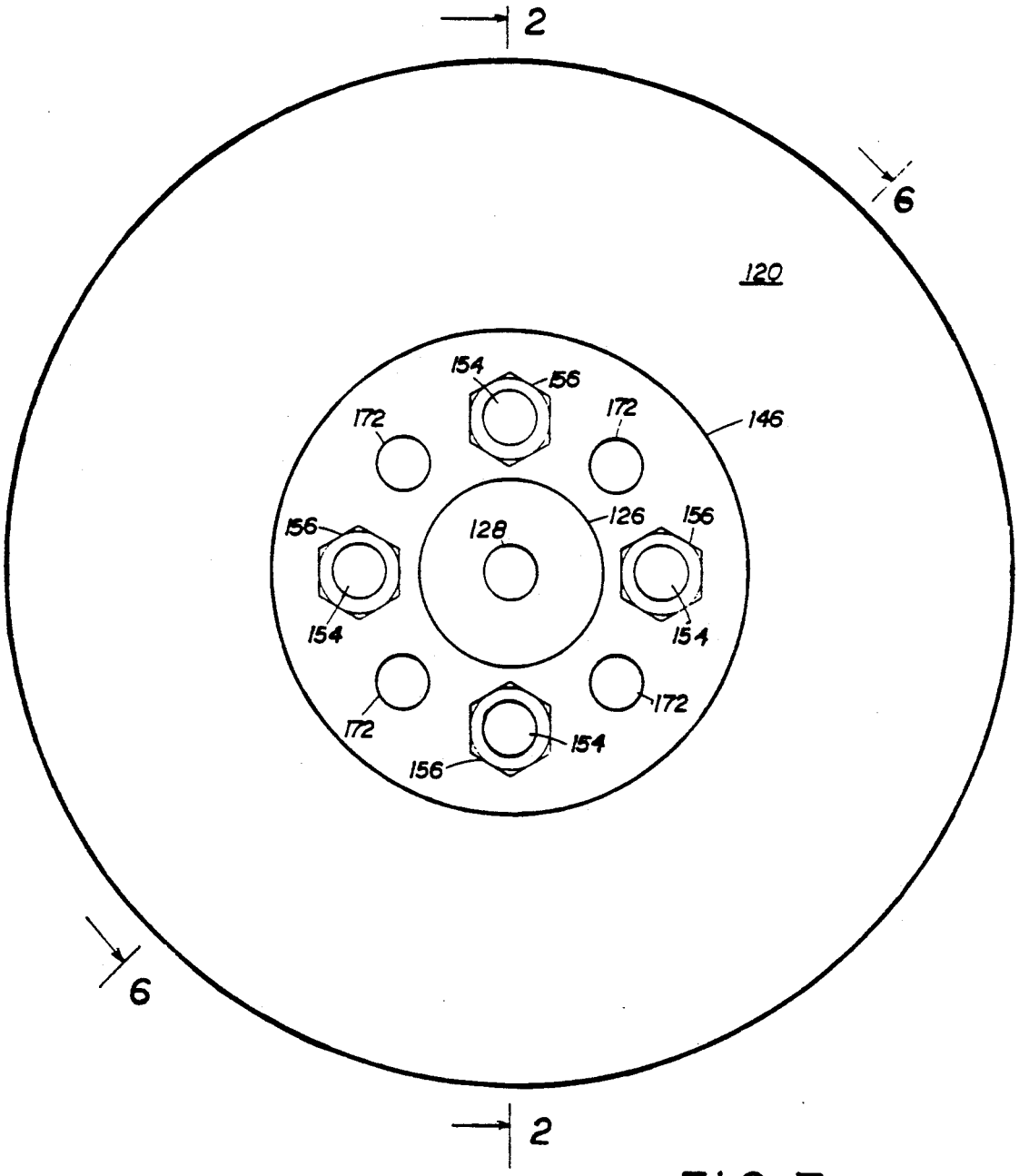
FIG. 7 is an end view of a second embodiment of the invention.
Figure 8:
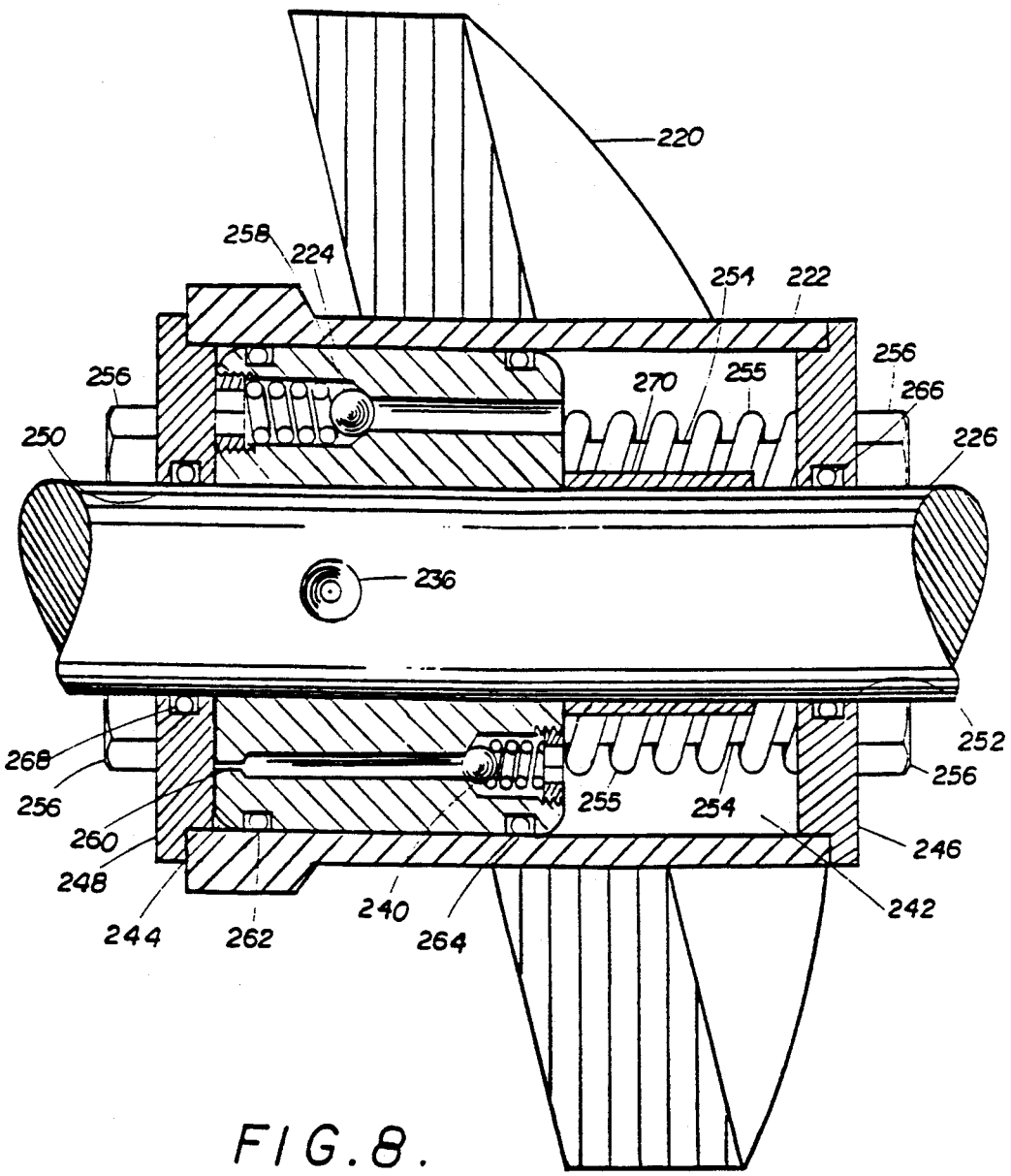
FIG. 8 is a view in section of a third embodiment of the invention.
Figure 9:
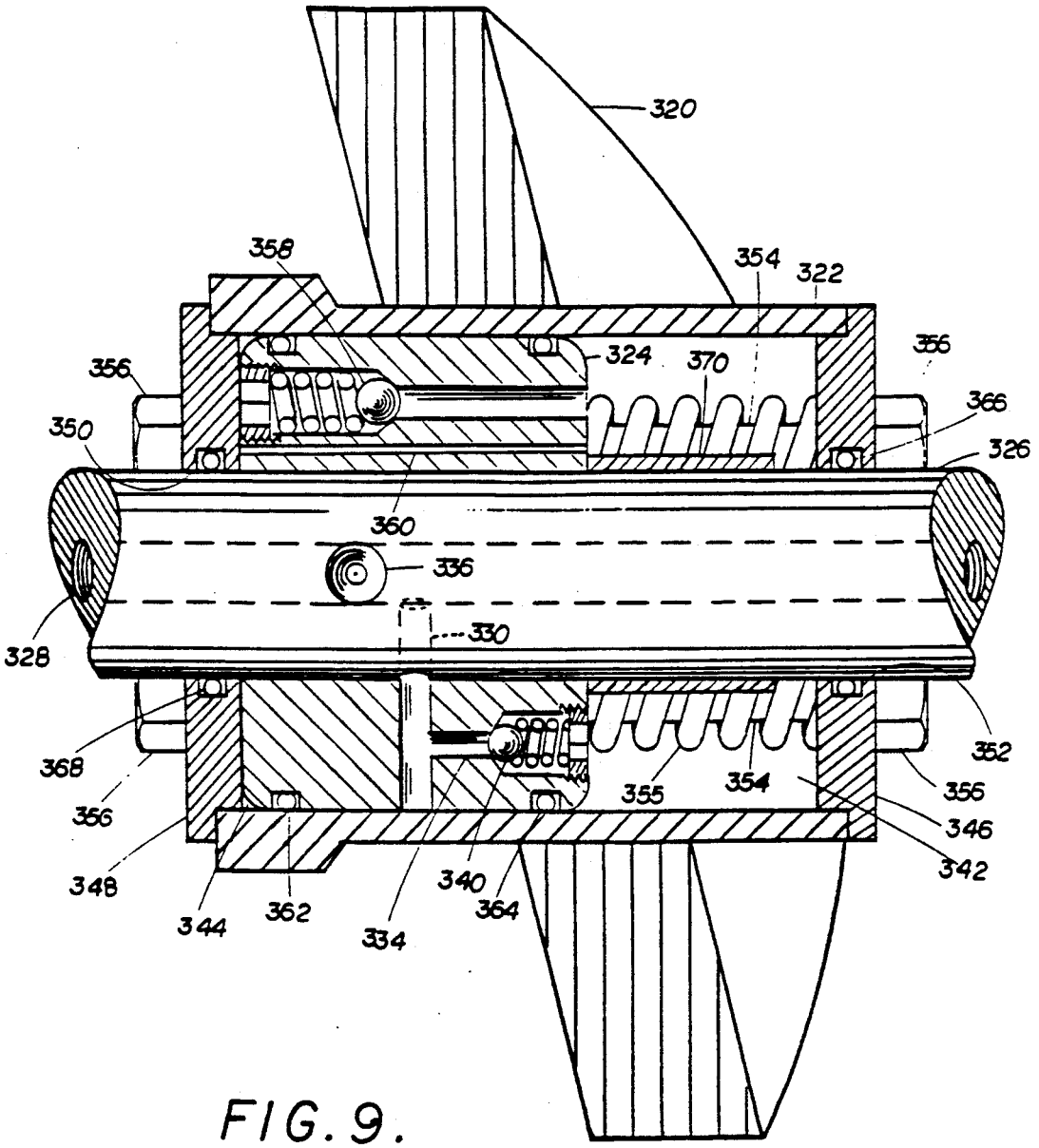
FIG. 9 is a view in section of a fourth embodiment of the invention.

In FIGS. 6 and 7, in this second embodiment of the invention a passage 128 through shaft 126 communicates with the lubrication system of the engine. Oil from a pump (not shown) flows through passageway 128 and passageway 130 to passageway 132 past a one-way check valve 138 to dash pot chamber 144 which is defined by end plate 148 that contains a restrictive orifice 160 that controls the movement of the mechanism at a predetermined rate. The spring chamber 142 is an "open" chamber in this embodiment that is defined by end plate 146 that contains openings 172 that allow for the free movement of the swashplate-cylinder whose movement is controlled only by dash pot chamber 144 and springs 155. In FIG. 8, the third embodiment of the invention employs a sealed "shock absorber" type hydraulic circuit whereby chamber 242 is filled with hydraulic fluid. When the pressure on the swashplate is sufficient the pressure relief valve 258 opens causing fluid to flow into chamber 244 and as pressure is reduced fluid flows back through restrictive orifice 260 past one-way check valve 240 to return to chamber 242, due to the action of springs 255. FIG. 9, the fourth embodiment of the invention only one one-way check valve 340 is used in the internal oil circuit but uses a restrictive orifice 360 to connect chambers 344 and 342 with a pressure relief valve to react to the pressure on swashplate 320. This embodiment has the advantage of using only one check valve and under some conditions of operation appears to better control and maintain the fluid in the dash pot chamber 344.

It is apparent that although I have described several embodiments of my invention, many other changes and modifications can be made therein without departing from the spirit of the invention as expressed by the appended claims.

What is claimed is:

1. A mechanism to convert reciprocating motion into rotary motion which will allow for the adjustment of the top dead center position of a piston in a cylinder in an axial engine to automatically vary the clearance volume in the combustion chambers of said axial engine comprising;

a cylinder and a swashplate are combined with said swashplate having a fixed inclination in relation to the bore of said cylinder; a shaft is combined with a piston with passages formed through said shaft and piston combination to allow for the flow of oil from a pump past check valves to a first chamber and a second chamber on each side of said piston, with an additional passage through said piston that communicates with said chambers, with a pressure relief valve of fixed value occupying said additional passage controlling the flow of oil from said first chamber to said second chamber, with an end plate defining said first chamber, said first chamber containing at least one spring held in compression by said end plate, with said end plate also forming a bearing surface around said shaft, while permitting the use of rod means to keep the main elements of the mechanism rotating together, a second end plate on the other side of said cylinder and swashplate combination defines said second chamber, with said second end plate forming a bearing surface around said shaft and containing a small opening permitting said second chamber to function as a dash pot to slow the axial movement of said cylinder and swashplate combination when it is responding to the action of the spring pressure in said first chamber, enabling said mechanism to adjust and limit the movement axially of said cylinder and swashplate combination along said piston and shaft combination which is fixed in relation to the rest of said engine.

2. A mechanism to convert reciprocating motion into rotary motion which will allow for the adjustment of the top dead center position of a piston in a cylinder in an axial engine to automatically vary the clearance volume in the combustion chambers of said axial engine comprising;

a cylinder and a swashplate are combined with said swashplate having a fixed inclination in relation to the bore of said cylinder; a shaft is combined with a piston with passages formed through said shaft and piston combination to allow for the flow of oil from a pump past check valves to a first chamber and a second chamber on each side of said piston, with an end plate defining said first chamber containing at least one spring held in compression by said end plate, with said piston housing a pressure relief valve of fixed value that opens when this value is reached, said end plate also forming a bearing surface around said shaft, while permitting the use of rod means to keep the main elements of the mechanism rotating together, a second end plate on the other side of said cylinder defines said second chamber with said second end plate forming a bearing surface around the shaft and containing a small opening permitting said second chamber to function as a dash pot to slow the axial movement of said cylinder and swashplate combination when it is responding to the action of the spring pressure in said first chamber enabling said mechanism to adjust and limit the movement axially of said cylinder and swashplate combination along said piston and shaft combination which is fixed in relation to the rest of said engine.

3. A mechanism to convert reciprocating motion into rotary motion which will allow for the adjustment of the top dead center position of a piston in a cylinder in an axial engine to automatically vary the clearance volume in the combustion chambers of said axial engine comprising;

a cylinder and a swashplate are combined with said swashplate having a fixed inclination in relation to the bore of said cylinder; a shaft is combined with a piston that defines a first chamber and a second chamber with passages formed through said shaft and piston combination to allow for the flow of oil from a pump past a check valve to said first chamber on one side of said piston, with an end plate defining said second chamber containing at least one spring held in compression by said end plate, at least one opening that permits the unrestricted flow of oil mist into and out of said second chamber, with said end plate also forming a bearing surface around said shaft while permitting the use of rod means to keep the main elements of the mechanism rotating together, a second end plate on the other side of said cylinder and swashplate combination defines said first chamber with said second end plate forming a bearing surface around said shaft and containing a small opening permitting said first chamber to function as a dash pot to slow the axial movement of said cylinder and swashplate combination when it is responding to the action of the spring pressure in said second chamber and enabling said mechanism to adjust and limit the movement axially of said cylinder and swashplate combination along said piston and shaft combination which is fixed in relation to the rest of said engine.

4. A mechanism to convert reciprocating motion into rotary motion which will allow for the adjustment of the top dead center position of a piston in a cylinder in an axial engine to automatically vary the clearance volume in the combustion chambers of said axial engine comprising;

a cylinder and a swashplate are combined with said swashplate having a fixed inclination in relation to the bore of said cylinder; a shaft is combined with a piston with two passages formed through said piston that communicate a first chamber and a second chamber on opposite sides of said piston with a pressure relief valve of fixed value occupying one said passages controlling the flow of fluid from said first chamber to said second chamber and a check valve occupying said second passage which is somewhat restrictive but allows for the flow of a suitable fluid from said second chamber to said first chamber with an end plate defining said first chamber containing at least one spring held in compression by said end plate with said end plate also forming a bearing surface around said shaft while permitting the use of rod means to keep the main elements of the mechanism rotating together, a second end plate on the other side of said cylinder swashplate defines said second chamber with said second end plate forming a bearing surface around said shaft, with seal means to effectively seal said chambers to prevent the loss of fluid from said chambers enabling the mechanism to adjust and limit the movement axially of said cylinder and swashplate combination along said piston and shaft combination which is fixed in relation to the rest of said engine.

5. A mechanism to convert reciprocating motion into rotary motion which will allow for the adjustment of the top dead center position of a piston in a cylinder in an axial engine to automatically vary the clearance volume in the combustion chambers of said axial engine comprising;

a cylinder and a swashplate are combined with said swashplate having a fixed inclination in relation to the bore of said cylinder; a shaft is combined with a piston which separates a first chamber and a second chamber with passages formed through said shaft and piston combination to allow for the flow of oil from a pump past a check valve to said first chamber on one side of said piston with a second passage through said piston that communicates with said first chamber and said second chamber with a pressure relief valve of fixed value occupying said second passage, said pressure relief valve controlling the flow of oil from said first chamber to said second chamber, a third passage is formed through said piston of somewhat restrictive size that communicates with said first chamber and said second chamber, with an end plate defining said first chamber containing at least one spring held in compression by said end plate, with said end plate also forming a bearing surface around said shaft while permitting the use of rod means to keep the main elements of the mechanism rotating together, a second end plate on the other side of said cylinder swashplate combination defines the second chamber with said second end plate forming a bearing surface around said shaft enabling the mechanism to adjust and limit the movement axially of said cylinder and swashplate combination along said piston and shaft combination which is fixed in relation to the rest of said engine.

* * * * *

UNITED STATES PATENT AND TRADEMARK OFFICE

CERTIFICATE OF CORRECTION

PATENT NO. : 5,083,532

DATED : January 28, 1992

INVENTOR(S) : Bernard Wiesen

It is certified that error appears in the above-indentified patent and that said Letters Patent is hereby corrected as shown below:

Column 1, line 52, change "mean" to means.

Column 4, line 56, change "piston housing" to end plate housing.

Signed and Sealed this

Seventh Day of September, 1993

Bruce Lehman

*Attest:*

BRUCE LEHMAN

*Attesting Officer*

*Commissioner of Patents and Trademarks*